US008226264B1

(12) United States Patent
Morejon et al.

(10) Patent No.: US 8,226,264 B1
(45) Date of Patent: Jul. 24, 2012

(54) SERIES MULTI-GROUP MODULAR SOLID STATE LIGHTING DEVICES

(75) Inventors: Israel J. Morejon, Tampa, FL (US); Jinhui Zhai, Oldsmar, FL (US); Evan O'Sullivan, Safety Harbor, FL (US); Thong Bui, Tarpon Springs, FL (US)

(73) Assignee: LEDnovation, Inc., Tampa, FL (US)

( * ) Notice: Subject to any disclaimer, the term of this patent is extended or adjusted under 35 U.S.C. 154(b) by 396 days.

(21) Appl. No.: 12/723,207

(22) Filed: Mar. 12, 2010

(51) Int. Cl.
*F21V 9/16* (2006.01)

(52) U.S. Cl. ..... 362/231; 362/249.02; 362/84

(58) Field of Classification Search ..... 362/84, 362/231, 249.02
See application file for complete search history.

(56) References Cited

U.S. PATENT DOCUMENTS

| | | | | |
|---|---|---|---|---|
| 7,213,940 | B1 | 5/2007 | Van De Ven et al. | |
| 7,387,405 | B2 * | 6/2008 | Ducharme et al. | 362/231 |
| 7,467,885 | B2 * | 12/2008 | Grotsch et al. | 362/555 |
| 7,600,882 | B1 * | 10/2009 | Morejon et al. | 362/84 |
| 7,731,390 | B2 * | 6/2010 | Van Gorkom et al. | 362/231 |
| 2010/0157586 | A1 * | 6/2010 | Yang | 362/230 |

* cited by examiner

*Primary Examiner* — Peggy A. Neils
(74) *Attorney, Agent, or Firm* — Ronald E. Smith; Smith & Hopen, P.A.

(57) ABSTRACT

A solid state lighting device includes a first group of semiconductor light emitting devices that produces a yellowish white light, a second group of semiconductor light emitting devices that includes at least one light emitting device that produces a reddish orange light, and a third group of semiconductor light emitting devices that includes at least one wavelength down-converted white light device. A combination of the second and third groups produces a sub-mixture of reddish warm white light. A combination of the first, second and third groups produces a mixture of warm white light with a correlated color temperature between 2700k to 3500K and a color rendering index higher than 85.

11 Claims, 2 Drawing Sheets

SERIES MULTI-GROUP MODULAR SOLID STATE LIGHTING DEVICES

BACKGROUND OF THE INVENTION

1. Field of the Invention

This invention relates, generally, to solid state lighting devices. More particularly, it relates to a solid state lighting device that provides warm white light with a high color rendering index at a high luminous efficacy.

2. Description of the Prior Art

The development of warm white solid state lighting devices having high efficiency has been restricted because a warm white light device with a high color rendering index (CRI) requires more long wavelength spectrum light, which is less sensitive to a human eye, thereby resulting in a low brightness light. Conventional high color rendering warm white light devices require more power than devices with a low color rendering index and such increased power produces device-debilitating heat.

There is a need for a solid state lighting device having a high color rendering index that consumes a relatively low amount of power so that it is not subjected to debilitating heat.

The current state of the art includes LEDs having a luminous efficacy of about 100~120 lm/W for cool white light (5000K~6500K) at a CRI of 60~75 and about 70~85 lm/W for warm white light (2700K~3000K) at a CRI of about 80 at 350 mA.

There is a need for an LED light source having a luminous efficacy above 100 lm/W at 350 mA for warm white light at a CRI of about 90. This would represent an improvement of more than forty percent (40%) over what a conventional phosphor converted warm white LED can achieve.

However, in view of the prior art considered as a whole at the time the present invention was made, it was not obvious to those of ordinary skill in the art how such a lighting device could be provided.

SUMMARY OF THE INVENTION

The long-standing but heretofore unfulfilled need for a solid state lighting device having a high color rendering index and a relatively low power consumption is now met by a new, useful, and non-obvious invention.

The inventive structure is a solid state lighting device that includes a first group of semiconductor light emitting devices that produce a yellowish white light having x, y coordinates that define a point above the Planckian locus on a 1931 CIE Chromaticity Diagram. The first group includes at least one blue semiconductor light emitter, one reddish orange semiconductor light emitter, and at least one wavelength down-conversion layer on top of the blue semiconductor light emitter to excite a converted greenish yellow spectrum light.

The inventive structure further includes a second group of semiconductor light emitting devices that includes at least one reddish orange semiconductor light emitter.

Moreover, the novel structure also includes a third group of semiconductor light emitting devices. The third group includes at least one wavelength down-converted white light device.

A structure that houses the light emitting devices includes a color mixing cavity having a diffusive output window and a light recycling reflector member disposed in overlying relation to an interior wall of the solid state lighting device and around the semiconductor light emitters.

Line power is supplied to the first, second, and third group of semiconductor light emitting devices.

A sub-mixture of reddish warm white light, having x, y coordinates that define a point below the Planckian locus on a 1931 CIE Chromaticity Diagram is produced when power is supplied to a combination of the second and third groups of semiconductor light emitting devices in absence of any additional light.

A mixture of warm white light with a correlated color temperature between 2700k~3500K and a color rendering index higher than 85, having x, y coordinates that define a point on the Planckian locus within 7-step MacAdam ellipses on a 1931 CIE Chromaticity Diagram is produced when power is supplied to a combination of the first, second and third groups of semiconductor light emitting devices in the absence of any additional light.

An important object of the invention is to provide a high brightness warm white light with a high color rendering index at relatively low power.

A closely related object is to provide said warm white light at a relatively low color temperature.

Another object is to provide a light emitting device module for solid state lighting devices with various color temperatures by reconfiguring the second and third group of semiconductor light emitters.

These and other important objects, advantages, and features of the invention will become clear as this disclosure proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
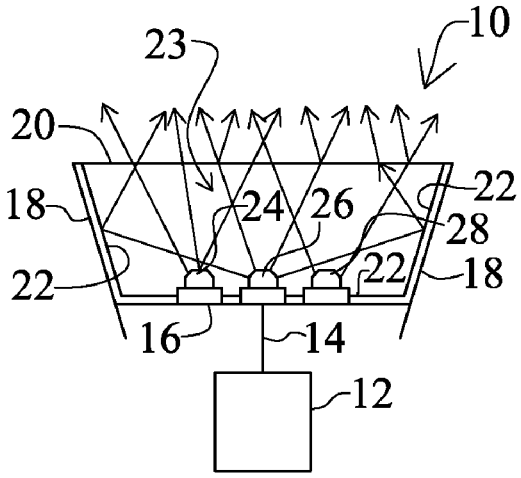
FIG. 1 is a side elevational, diagrammatic view of the novel solid state lighting device.

Referring now to FIG. 1, it will there be seen that a diagrammatic representation of the novel solid state lighting device is denoted as a whole by the reference numeral 10. The novel structure may be a part of solid state devices such as A19 light bulbs, downlights, ceiling architectural luminaires, and the like. Device 10 includes electrical conversion device 12 in the form of a rectifier and step-down transformer for converting AC line current to DC and for reducing the voltage to the voltage required for a solid state lighting device. Conductor 14 provides electrical communication between device 12 and thermally conductive PCB substrate 16. A plurality of conductive traces, not shown, is etched in said thermally conductive substrate and the lighting devices of this invention are in electrical communication with selected conductive traces of said plurality of conductive traces.

Wall 18, having a frusto-conical shape in this example, circumscribes the periphery of thermally conductive substrate 16 and light translucent window 20 overlies the rim of said wall. Backscatter recycling reflector material 22 overlies thermally conductive substrate 16 and the interior surfaces of said wall 18. The hollow interior of the structure defines color mixing cavity 23. The single-headed arrows represent light rays. Reflector material 22 does not underlie the semiconductor light emitting devices mounted atop thermal conductive substrate 16 but it is disposed in abutting and surrounding relation to each of them. Accordingly, no part of thermally conductive substrate 16 is exposed to the light rays in color mixing cavity 23.

Novel lighting device 10 further includes a first group of semiconductor light emitting devices 24, only one of which appears in this view, a second group of semiconductor light emitting devices 26, only one of which appears in this view, and a third group of semiconductor light emitting devices 28, only one of which appears in this view.

Figure 2:
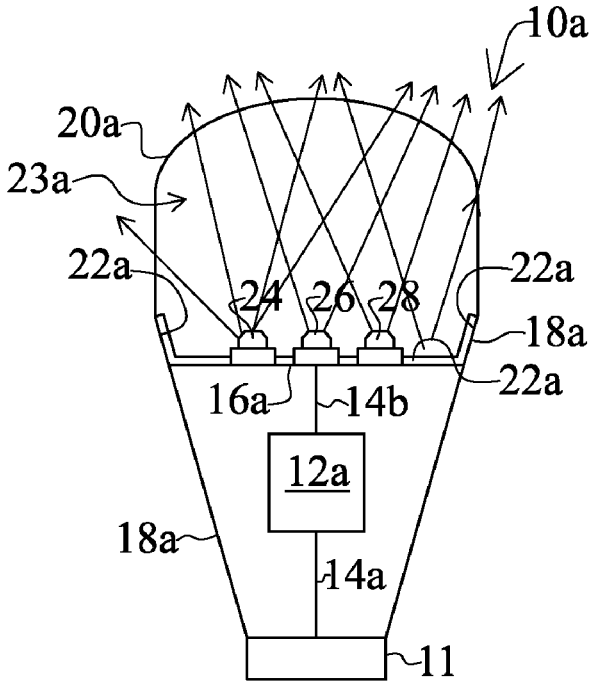
FIG. 2 is a side elevational, diagrammatic view of the novel solid state lighting device when provided in the general form of a light bulb.

FIG. 2 illustrates that the inventive parts may also be provided in the form of a somewhat conventional-in-appearance light bulb 10*a* having a power connector base 11, electrical conversion device 12*a*, first conductor 14*a* providing electrical communication between power base 11 and device 12*a*, and second conductor 14*b* providing electrical communication between said electrical conversion device and thermally conductive PCB substrate 16*a*. Conductive traces, not shown, are etched in said thermally conductive substrate.

Thermally conductive body 18*a*, having a frusto-conical shape in this example, extends from power base 11 at its lower end and circumscribes the periphery of thermally conductive PCB substrate 16*a* at its upper end. Bulb-shaped light translucent window 20*a* overlies the rim of said body 18*a*. Backscatter recycling reflector material 22*a* overlies thermally conductive substrate 16*a* and the interior walls of said body 18*a*. The hollow interior of the structure defines color mixing cavity 23*a*. The single-headed arrows represent light rays. Reflector material 22*a* does not underlie the semiconductor light emitting devices mounted atop thermally conductive substrate 16*a* but it is disposed in abutting and surrounding relation to each of them. Accordingly, no part of thermal conductive substrate 16*a* is exposed to the light rays in color mixing cavity 23*a*.

Novel lighting device 10*a* further includes a first group of semiconductor light emitting devices 24, only one of which appears in this view, a second group of semiconductor light emitting devices 26, only one of which appears in this view, and a third group of semiconductor light emitting devices 28, only one of which appears in this view.

Figure 3:
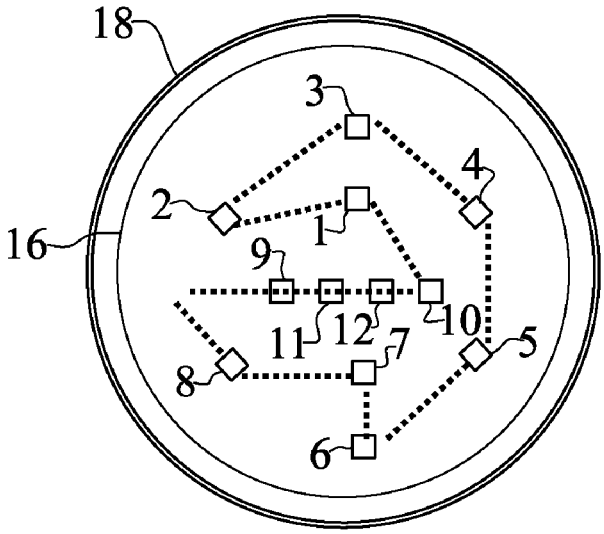
FIG. 3 is a top plan, diagrammatic view of depicting a first arrangement of the novel solid state lighting device.
Figure 4:
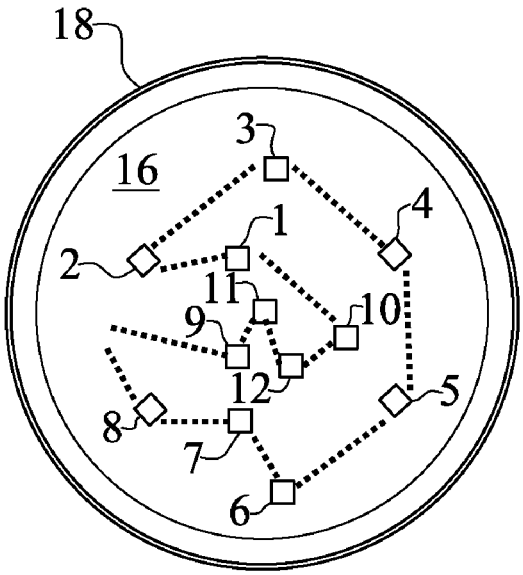
FIG. 4 is a top plan, diagrammatic view of a second arrangement of parts.

FIGS. 3 and 4 depict first and second arrangements of said first, second, and third groups of light emitters.

In FIG. 3, first group of semiconductor light emitting devices 24 produces a yellowish white light having x, y coordinates that define a point above the Planckian locus on a 1931 CIE Chromaticity Diagram. First group 24 includes at least one blue semiconductor light emitter 24*a*, one reddish orange semiconductor light emitter 24*b*, and at least one wavelength down-conversion layer, not depicted, disposed on top of blue semiconductor light emitter 24*a* to excite a converted greenish yellow spectrum light. The LEDs of the first group are numbered 1-8.

The first group of blue semiconductor light emitters 24*a* emits light having a dominant wavelength in a range of 430 nm~470 nm. The first group of reddish orange semiconductor light emitters 24*b* emits light having a dominant wavelength in a range of 600 nm~650 nm.

More particularly, the sub-mixture of the first group, in the absence of any additional light, produces a yellowish white light having x, y color coordinates that defines a point above the Planckian locus within an area enclosed by four (4) points having x, y coordinates of (0.4, 0.4), (0.46, 0.42), (0.44, 0.49), and (0.38, 0.42).

Second group 26 includes at least one reddish orange semiconductor light emitter 26*a*. The LEDs of the second group are numbered 9, 10. The second group of reddish orange semiconductor light emitter 26*a* emits light having a dominant wavelength in a range of 610 nm~640 nm.

Third group 28 includes at least one wavelength down-converted white light device 28*a*. The LEDs of the third group are numbered 11, 12. The third group of white light devices 28*a* emits light having color temperature between 3500k~6500k.

Combination of the second and third groups 26, 28, in the absence of any additional light, produces a sub-mixture of reddish warm white light having x, y color coordinates that define a point below the Planckian locus within an area enclosed by four (4) points having x, y coordinates of (0.37, 0.32), (0.53, 0.35), (0.52, 0.41), and (0.36, 0.35).

The embodiment of FIG. 4 differs from that of FIG. 3 only in the physical arrangement of the LEDs. The multi-color LEDs of FIG. 4 are more symmetrically arranged for a more uniform color mixing.

In both embodiments, the string of LEDs that forms first group 24 generally encircles the LED strings that form second group 26 and third group 28, i.e., the LEDs forming said first group 24 are radially outwardly disposed relative to the LEDs of the second and third groups. The LEDs of second group 26 are radially arranged between first group 24 and third group 28 to avoid reddish color separation produced from the solid state light device.

The straight dotted lines between the light emitting devices indicate that the devices are interconnected to one another, forming an LED string.

More particularly, in the embodiment of FIG. 3, the No. 9 and 10 LEDs flank the No. 11 and 12 LEDs and all four of said LEDs form a straight line along the diameter of the lighting fixture as depicted. Moreover, LED Nos. 1, 3, 6, and 7 are also aligned with one another in perpendicular relation to the LEDs of said second and third groups. LED Nos. 2, 4, 5, and 8 form the corners of an imaginary rectangle. Accordingly, the arrangement of FIG. 3 is understood to be a symmetrical arrangement.

The LEDs of FIG. 4 are therefore understood to be arranged in a more symmetrical pattern for uniform multi-colors mixing. The LEDs of the second and third groups in this arrangement are staggered relative to one another. LED Nos. 2, 3, 4, 5, 6, and 8 emit a greenish yellow white color and are radially outwardly disposed in a symmetrical hexagonal arrangement. LED Nos. 1, 7 and 10 emit a reddish orange color and are radially inwardly disposed in a symmetrical triangular arrangement. LED Nos. 9, 11 and 12 emit a white and reddish orange mixing color and are centrally disposed in a symmetrical triangular arrangement.

The novel lighting fixture has a luminous efficacy of 110·130 lm/W at 350 mA for warm white light at a CRI of about 90 at the LED level.

The novel lighting fixture also has the capability to produce different color temperature from the same light emitting device module by reconfiguring second and third group of semiconductor light emitters 26, 28.

In another embodiment, the second and third groups of semiconductor light emitters 26, 28 include at least one reddish orange light emitter and at least one neutral white light emitter having color temperature of 3500~4500K. Combination of the second and third groups 26, 28, in the absence of any additional light, produces a sub-mixture of reddish warm white light having x, y color coordinates that define a point below the Planckian locus within an area enclosed by four (4) points having x, y coordinates of (0.47, 0.34), (0.53, 0.35), (0.52, 0.41), and (0.46, 0.385). A mixture of warm white light with a correlated color temperature of 2700k and a color rendering index higher than 85, having x, y coordinates that define a point on the Planckian locus within 7-step MacAdam ellipses on a 1931 CIE Chromaticity Diagram is produced when power is supplied to a combination of the first, second and third groups of semiconductor light emitting devices in the absence of any additional light.

In another embodiment, the second and third groups of semiconductor light emitters 26, 28 include at least one reddish orange light emitter and at least one cool white light emitter having color temperatures in the range of 5000~6500K. Combination of the second and third groups 26, 28, in the absence of any additional light, produces a sub-mixture of reddish warm white light having x, y color coordinates that define a point below the Planckian locus within an area enclosed by four (4) points having x, y coordinates of (0.42, 0.33), (0.47, 0.34), (0.46, 0.385), and (0.415, 0.37). A mixture of warm white light with a correlated color temperature of 3000k and a color rendering index higher than 85, having x, y coordinates that define a point on the Planckian locus within 7-step MacAdam ellipses on a 1931 CIE Chromaticity Diagram is produced when power is supplied to a combination of the first, second and third groups of semiconductor light emitting devices in the absence of any additional light.

In another embodiment, the second and third groups of semiconductor light emitters 26, 28 include a different number of reddish orange light emitters and cool white light emitters having color temperature of 5000~6500K. Combination of the second and third groups 26, 28, in the absence of any additional light, produces a sub-mixture of reddish warm white light having x, y color coordinates that define a point below the Planckian locus within an area enclosed by four (4) points having x, y coordinates of (0.37, 0.32), (0.42, 0.33), (0.415, 0.37), and (0.36, 0.35). A mixture of warm white light with a correlated color temperature of 3500k and a color rendering index higher than 85, having x, y coordinates that define a point on the Planckian locus within 7-step MacAdam ellipses on a 1931 CIE Chromaticity Diagram is produced when power is supplied to a combination of first, second and third groups of semiconductor light emitting devices in the absence of any additional light.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A solid state lighting device, comprising:

a first group of semiconductor light emitting devices that produce a yellowish white light having x, y coordinates that define a point above the Planckian locus on a 1931 CIE Chromaticity Diagram;

said first group including at least one blue semiconductor light emitter, one reddish orange semiconductor light emitter, and at least one wavelength down-conversion layer on top of the blue semiconductor light emitter to excite a converted greenish yellow spectrum light;

a second group of semiconductor light emitting devices that includes at least one light emitting device that produces a reddish orange light; and a third group of semiconductor light emitting devices including at least one wavelength down-converted white light device.

2. The device of claim 1, further comprising:

said first group, in the absence of any additional light, producing a yellowish white light having x, y color coordinates that define a point above the Planckian locus within an area enclosed by four (4) points having x, y coordinates of (0.4, 0.4), (0.46, 0.42), (0.44, 0.49), and (0.38, 0.42).

3. The device of claim 1, further comprising:

a combination of the second and third groups of semiconductor light emitting devices producing a sub-mixture of reddish warm white light, having x, y coordinates that define a point below the Planckian locus on a 1931 CIE Chromaticity Diagram when power is supplied to said combination of the second and third groups of semiconductor light emitting devices in absence of any additional light.

4. The device of claim 3, further comprising:

said combination of said second and third groups, in the absence of any additional light, producing a reddish warm white light having x, y color coordinates that define a point below the Planckian locus within an area enclosed by four (4) points having x, y coordinates of (0.37, 0.32), (0.53, 0.35), (0.52, 0.41), and (0.36, 0.35).

5. The device of claim 1, further comprising:

a combination of said first, second and third groups of semiconductor light emitting devices producing a mixture of warm white light with a correlated color temperature between 2700k to 3500K and a color rendering index higher than 85, having x, y coordinates that define a point on said Planckian locus within 7-step MacAdam ellipses on a 1931 CIE Chromaticity Diagram when power is supplied to said combination of said first, second, and third groups in absence of any additional light.

6. The device of claim 1, further comprising:

a combination of said first, second, and third groups having a luminous efficacy of 110~130 lm/W at 350 mA for warm white light at a color rendering index of about 90 at the LED level.

7. The solid state lighting device of claim 1, further comprising:

a housing for said light emitting device;

a thermally conductive substrate having a plurality of conductive traces etched therein;

said first, second, and third groups of semiconductor light emitting devices being mounted on said thermally conductive substrate in electrical communication with selected conductive traces of said plurality of conductive traces;

a backscatter recycling reflector material disposed in overlying relation to said thermally conductive substrate and in surrounding relation to each semiconductor light emitting device of said first, second, and third groups;

said housing being mounted about a periphery of said thermally conductive substrate;

said housing having an interior wall;

said backscatter recycling reflector material disposed in overlying relation to said interior wall;

a rim defined by an open upper end of said housing;

a light translucent window mounted to said rim; and a color mixing cavity defined by said thermally conductive substrate, said housing, and said light translucent window.

8. A solid state lighting device, comprising:

a first group of semiconductor light emitting devices that produce a yellowish white light having x, y coordinates that define a point above the Planckian locus on a 1931 CIE Chromaticity Diagram;

said first group including at least one blue semiconductor light emitter, one reddish orange semiconductor light emitter, and at least one wavelength down-conversion layer on top of the blue semiconductor light emitter to excite a converted greenish yellow spectrum light;

a second group of semiconductor light emitting devices that includes at least one light emitting device that produces a reddish orange light and one neutral white light emitter;

a third group of semiconductor light emitting devices including at least one wavelength down-converted white light device;

a combination of said second and third groups producing a sub-mixture of reddish warm white light having x, y color coordinates that define a point below the Planckian locus within an area enclosed by four (4) points having x, y coordinates of (0.47, 0.34), (0.53, 0.35), (0.52, 0.41), and (0.46, 0.385); and a combination of said first, second and third groups producing a mixture of warm white light with a correlated color temperature of 2700k and a color rendering index higher than 85, having x, y coordinates that define a point on the Planckian locus within 7-step MacAdam ellipses on a 1931 CIE Chromaticity Diagram when power is supplied to said combination in the absence of additional light.

9. A solid state lighting device, comprising:

a first group of semiconductor light emitting devices that produce a yellowish white light having x, y coordinates that define a point above the Planckian locus on a 1931 CIE Chromaticity Diagram;

said first group including at least one blue semiconductor light emitter, one reddish orange semiconductor light emitter, and at least one wavelength down-conversion layer on top of the blue semiconductor light emitter to excite a converted greenish yellow spectrum light;

a second group of semiconductor light emitting devices that includes at least one light emitting device that produces a reddish orange light and one cool white light emitter;

a third group of semiconductor light emitting devices including at least one wavelength down-converted white light device;

a combination of said second and third groups producing a sub-mixture of reddish warm white light having x, y color coordinates that define a point below the Planckian locus within an area enclosed by four (4) points having x, y coordinates of (0.42, 0.33), (0.47, 0.34), (0.46, 0.385), and (0.415, 0.37); and a combination of said first, second and third groups producing a mixture of warm white light with a correlated color temperature of 3000k and a color rendering index higher than 85, having x, y coordinates that define a point on the Planckian locus within 7-step MacAdam ellipses on a 1931 CIE Chromaticity Diagram when power is supplied to said combination in the absence of additional light.

10. A solid state lighting device, comprising:

a first group of semiconductor light emitting devices that produce a yellowish white light;

said first group including at least one blue semiconductor light emitter, one reddish orange semiconductor light emitter, and at least one wavelength down-conversion layer on top of the blue semiconductor light emitter to excite a converted greenish yellow spectrum light having x, y coordinates that define a point above the Planckian locus on a 1931 CIE Chromaticity Diagram;

a second group of semiconductor light emitting devices that includes at least one light emitting device that produces a reddish orange light and a plurality of cool white light emitters;

a third group of semiconductor light emitting devices including at least one wavelength down-converted white light device;

a combination of said second and third groups producing a sub-mixture of reddish warm white light having x, y color coordinates that define a point below the Planckian locus within an area enclosed by four (4) points having x, y coordinates of (0.37, 0.32), (0.42, 0.33), (0.415, 0.37), and (0.36, 0.35); and a combination of said first, second and third groups producing a mixture of warm white light with a correlated color temperature of 3500k and a color rendering index higher than 85, having x, y coordinates that define a point on the Planckian locus within 7-step MacAdam ellipses on a 1931 CIE Chromaticity Diagram when power is supplied to said combination in the absence of additional light.

11. The solid state lighting device of claim 1, further comprising:

said first group including a first string of LEDs;

said second group including a second string of LEDs;

said third group including a third string of LEDs;

said first string of LEDS disposed in encircling relation to said second and third strings of LEDs, radially outwardly thereof; and said second string of LEDS disposed radially outwardly of said third string of LEDs, to avoid reddish color separation produced from the solid state lighting device.

* * * * *